US008267055B2

(12) United States Patent
Pattakos et al.

(10) Patent No.: US 8,267,055 B2
(45) Date of Patent: Sep. 18, 2012

(54) VARIABLE COMPRESSION RATIO ENGINE

(76) Inventors: Manousos Pattakos, Nikea Piraeus (GR); Vithleem Sanniou-Pattakou, Athens (GR); Emmanouel Pattakos, Nikea Piraeus (GR)

( * ) Notice: Subject to any disclaimer, the term of this patent is extended or adjusted under 35 U.S.C. 154(b) by 518 days.

(21) Appl. No.: 12/553,975

(22) Filed: Sep. 3, 2009

(65) Prior Publication Data

US 2011/0048383 A1 Mar. 3, 2011

(51) Int. Cl.
*F02B 75/04* (2006.01)

(52) U.S. Cl. ..... 123/48 B; 123/78 F

(58) Field of Classification Search ..... 123/48 R, 123/48 B, 78 R, 78 F
See application file for complete search history.

(56) References Cited

U.S. PATENT DOCUMENTS 5,908,014 A * 6/1999 Leithinger ..... 123/78 F
6,247,430 B1 * 6/2001 Yapici ..... 123/78 F
6,588,384 B2 * 7/2003 Yapici ..... 123/78 F
6,971,342 B1 * 12/2005 Grabbe ..... 123/48 B
7,174,865 B2 * 2/2007 Sakita ..... 123/78 F

* cited by examiner

*Primary Examiner* — Noah Kamen

(57) ABSTRACT

An eccentric ring is interposed between the big end bearing of the connecting rod and the crankpin.

The eccentric ring is secured at one end of a secondary connecting rod, the other end of the secondary connecting rod being rotatably mounted on a crankpin of a secondary crankshaft.

The angular displacement of the rotation axis of the secondary crankshaft about the rotation axis of the crankshaft controls the compression ratio.

The secondary crankshaft and the secondary connecting rod carry a tiny part of the loads of the engine, some 1/20, enabling compact, true lightweight and robust structure.

The kinematics of the piston remains unchanged.

The balance of the engine remains unchanged.

The application on V engines is more economical: a small secondary connecting rod per pair of cylinders, a single and slight secondary crankshaft and a single control frame is all it takes.

7 Claims, 25 Drawing Sheets

VARIABLE COMPRESSION RATIO ENGINE

BACKGROUND OF THE INVENTION

In PCT/EP2009/051702, which is the closest prior art, an eccentric ring is interposed between the crankpin and the big end bearing of the connecting rod. The eccentric ring rotates in synchronization to the crankshaft by means of a set of gear wheels. The rotation of a control member changes the phase between the crankshaft and the eccentric ring and so controls the compression ratio.

The necessary eccentricity between the inner and outer cylindrical surfaces of the eccentric ring is small, for instance a 4 mm eccentricity enables a compression ratio range between 8:1 and 18:1 in an engine having 100 mm piston stroke.

Among the drawbacks of the closest prior art are the degradation of the crankshaft strength, the increased complication, size and cost, the additional inertia vibrations, the need for special cylinder arrangement in order to keep reasonable the number of additional parts.

BRIEF SUMMARY OF THE INVENTION

This invention proposes a Variable Compression Ratio (VCR) mechanism based on the eccentric ring principle, too. But instead of a gear wheel, the eccentric ring is secured at the one end of a secondary connecting rod. The eccentric ring, interposed between the big end bearing of the connecting rod and the crankpin, is secured at one end of the secondary connecting rod, the other end of the secondary connecting rod is rotatably mounted on a crankpin of a secondary crankshaft. Displacing the rotation axis of the secondary crankshaft about the rotation axis of the crankshaft, the compression ratio changes.

DETAILED DESCRIPTION OF THE DRAWINGS

Figure 1:
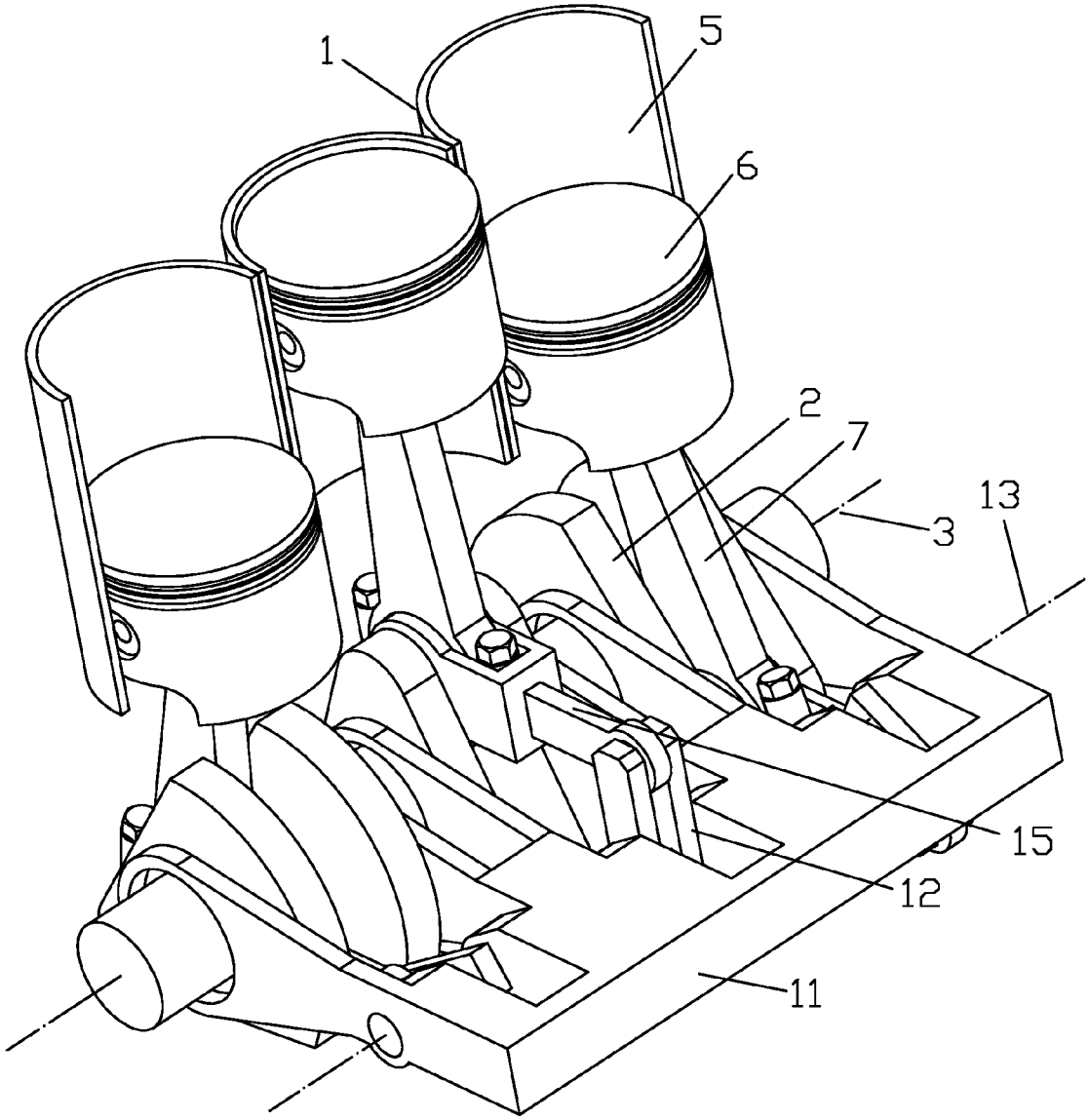
FIG. 1 shows a three-in-line engine at a medium compression ratio.
Figure 2:
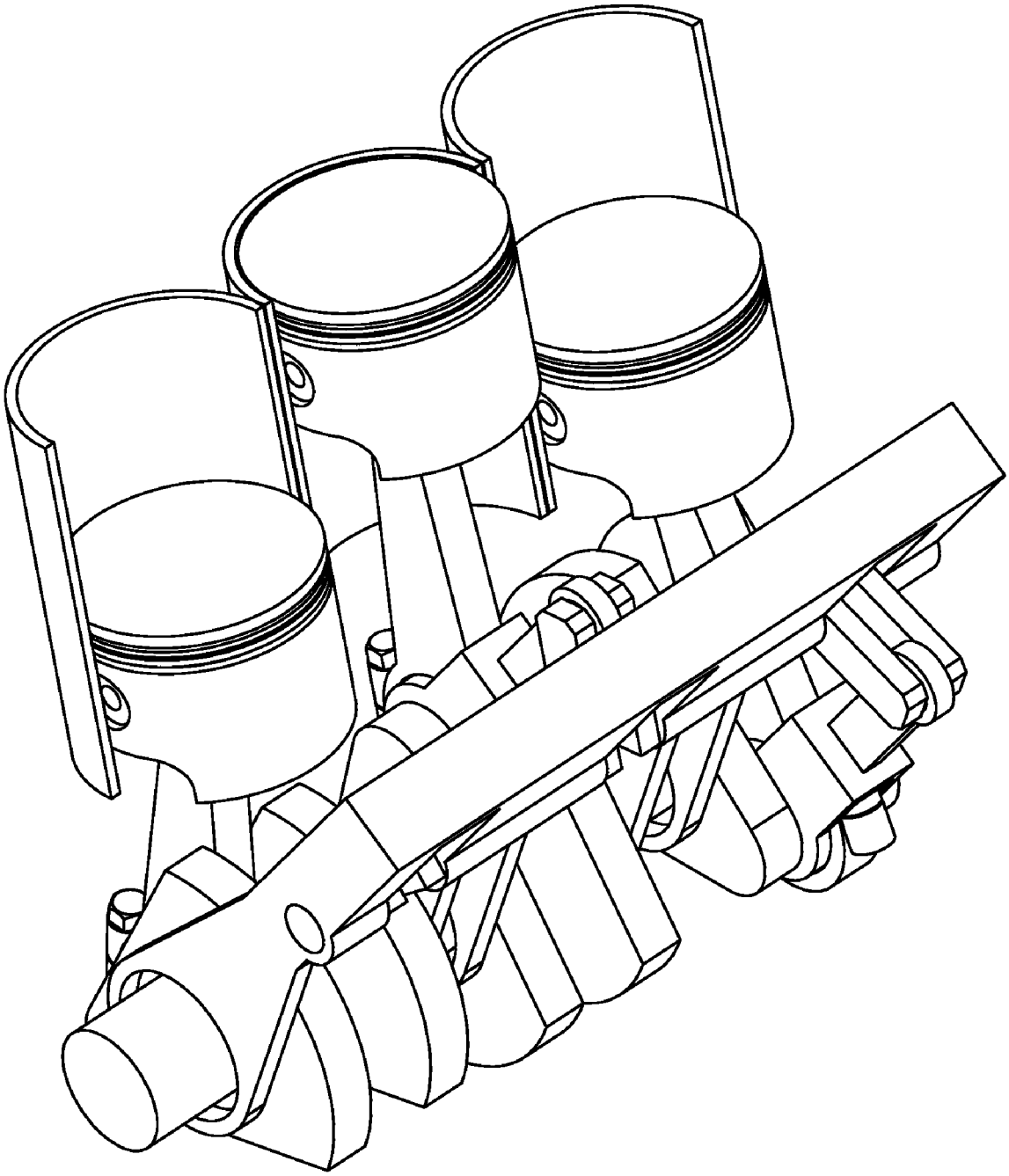
FIG. 2 shows the engine of FIG. 1 at a high compression ratio.
Figure 3:
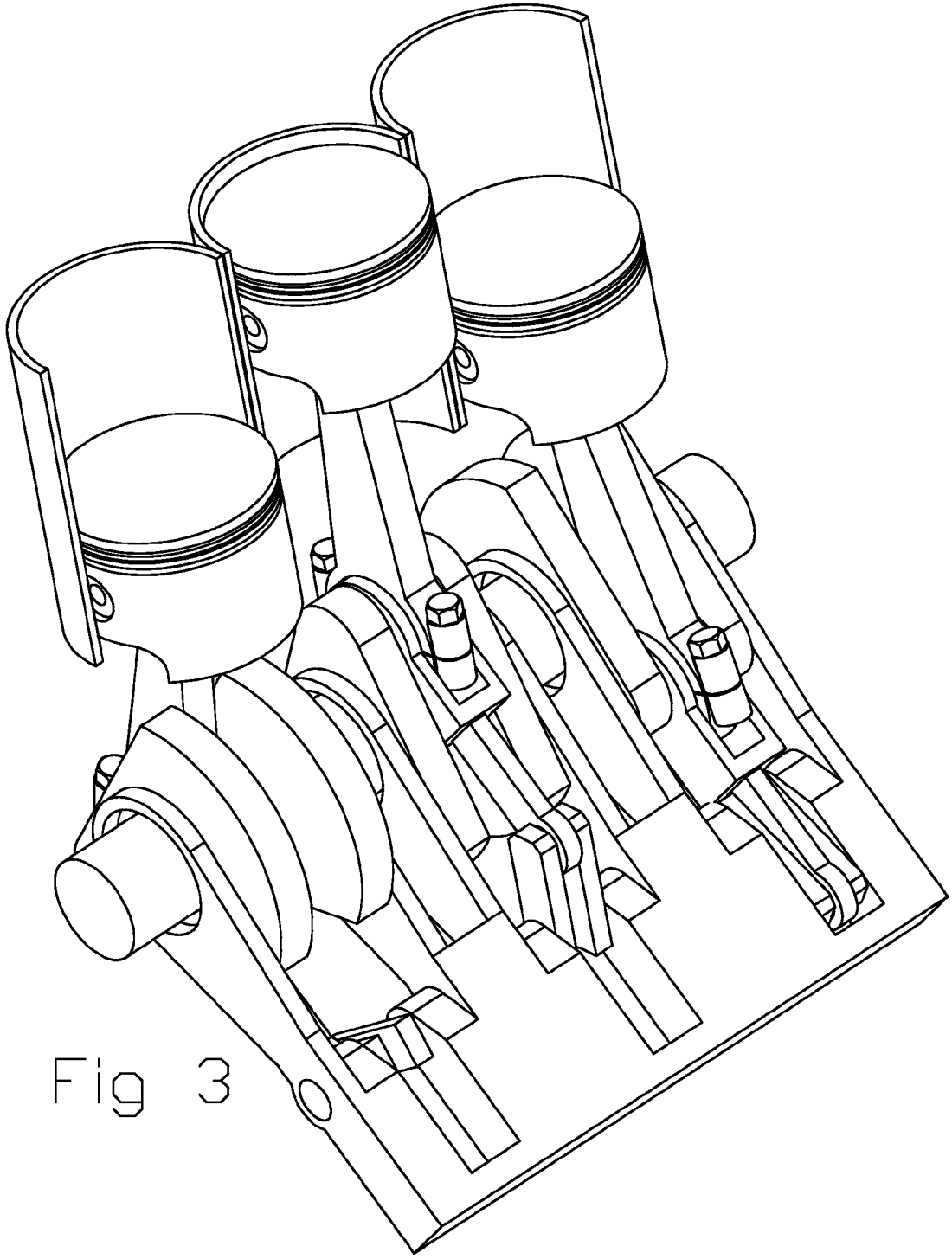
FIG. 3 shows the engine of FIG. 1 at a low compression ratio.
Figure 4:
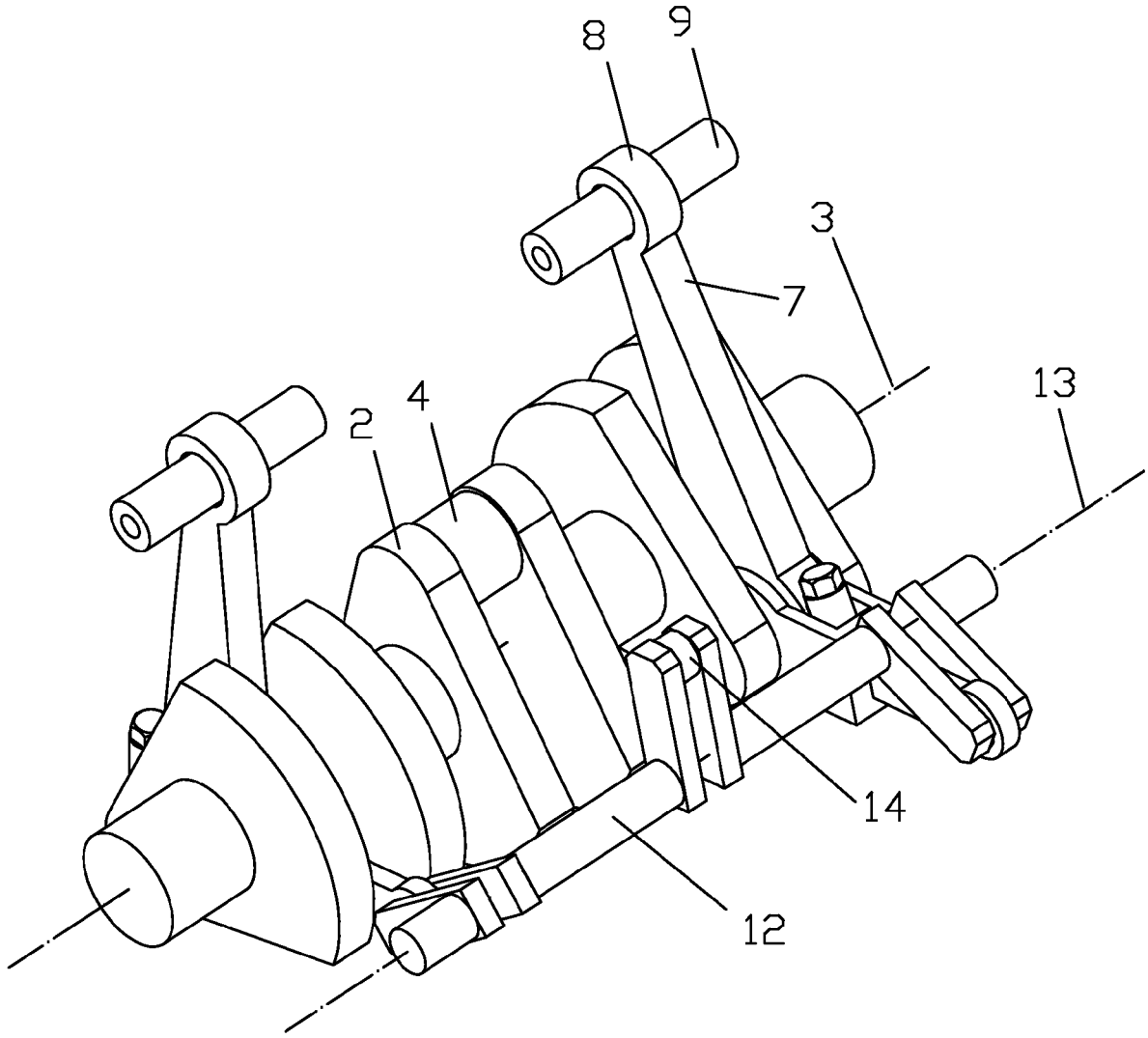
FIG. 4 shows the engine of FIG. 1 with some parts removed.
Figure 5:
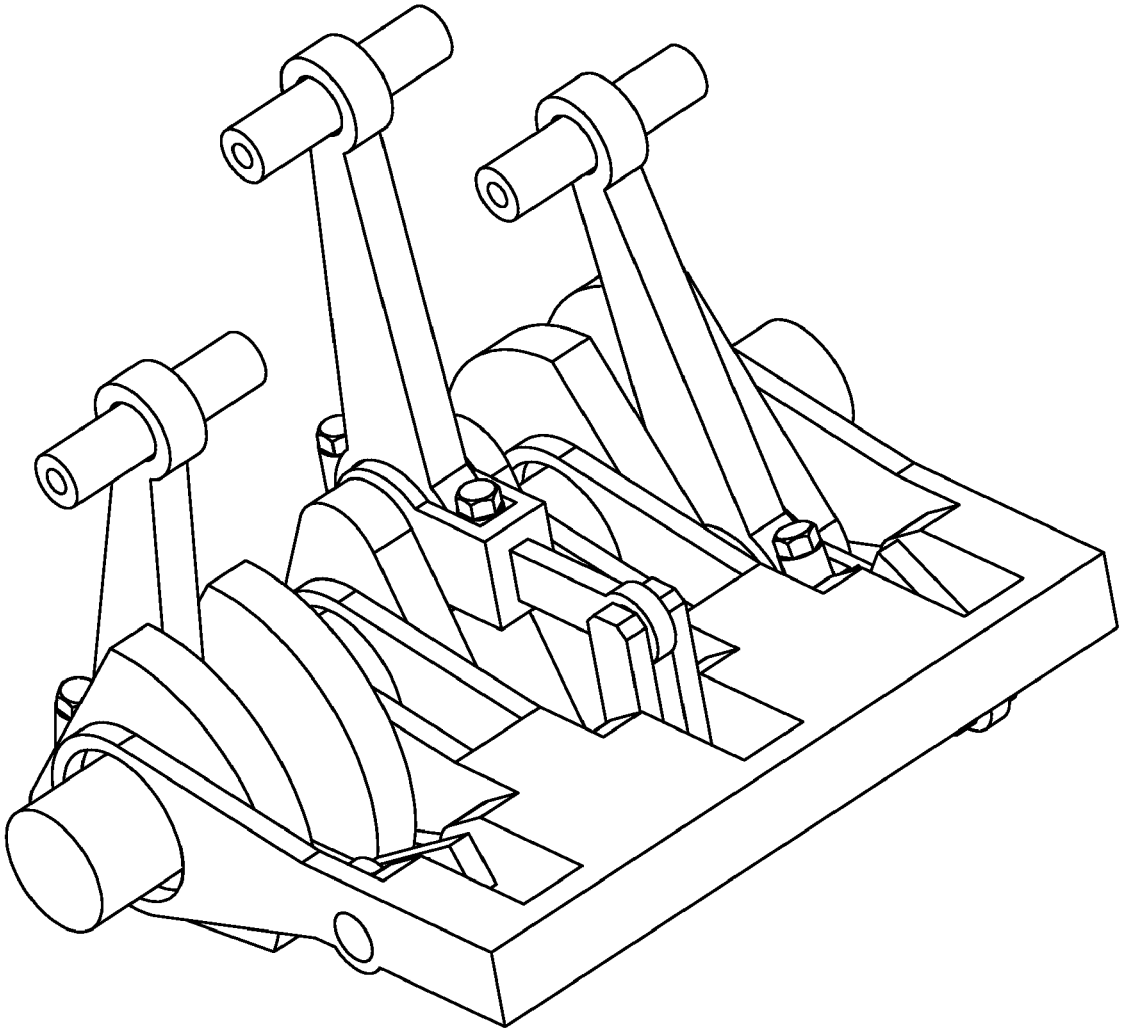
FIG. 5 shows the engine of FIG. 1 with the cylinders and the pistons removed.
Figure 6:
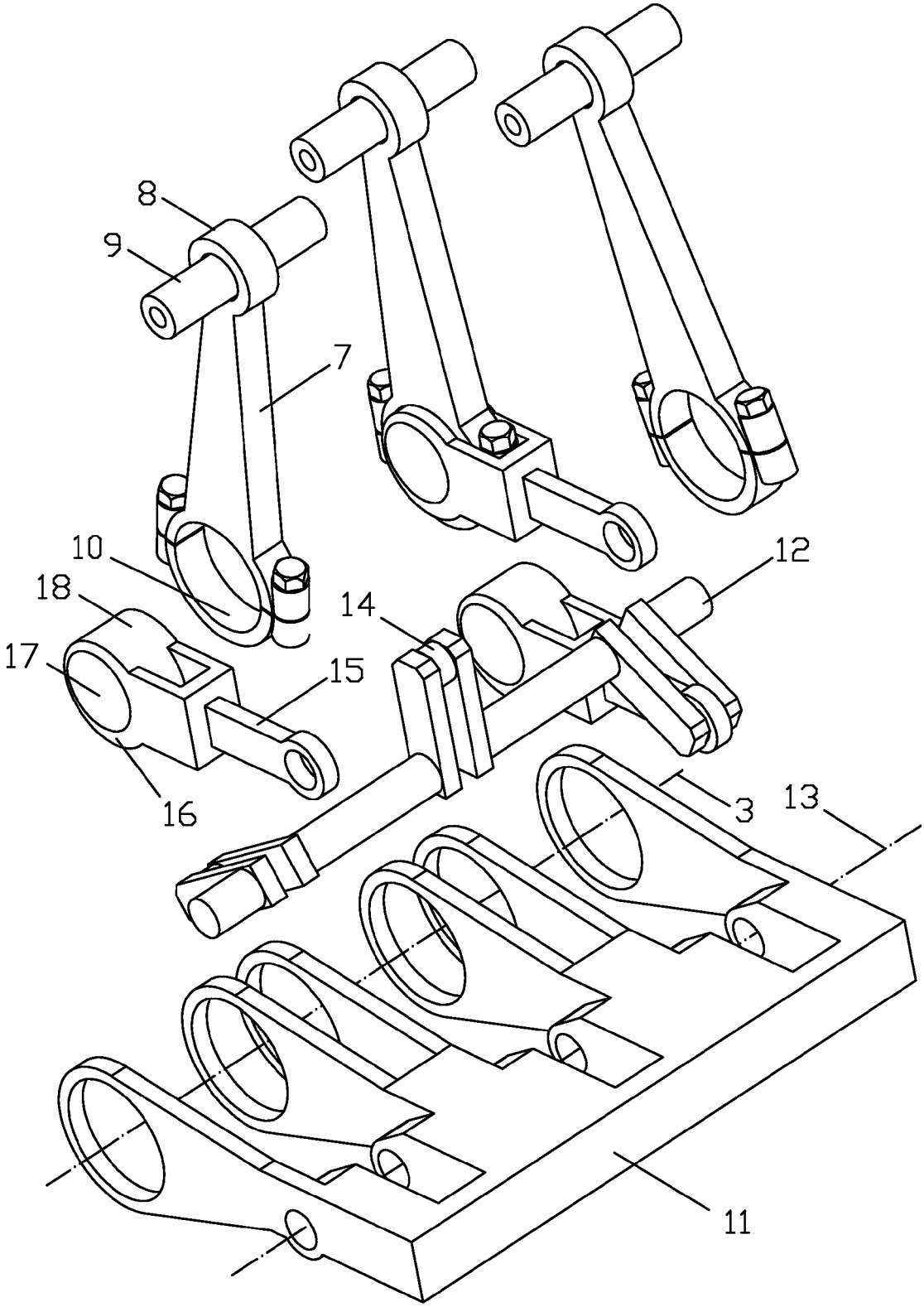
FIG. 6 shows the basic parts of the variable compression ratio mechanism of the engine of FIG. 1.
Figure 7:
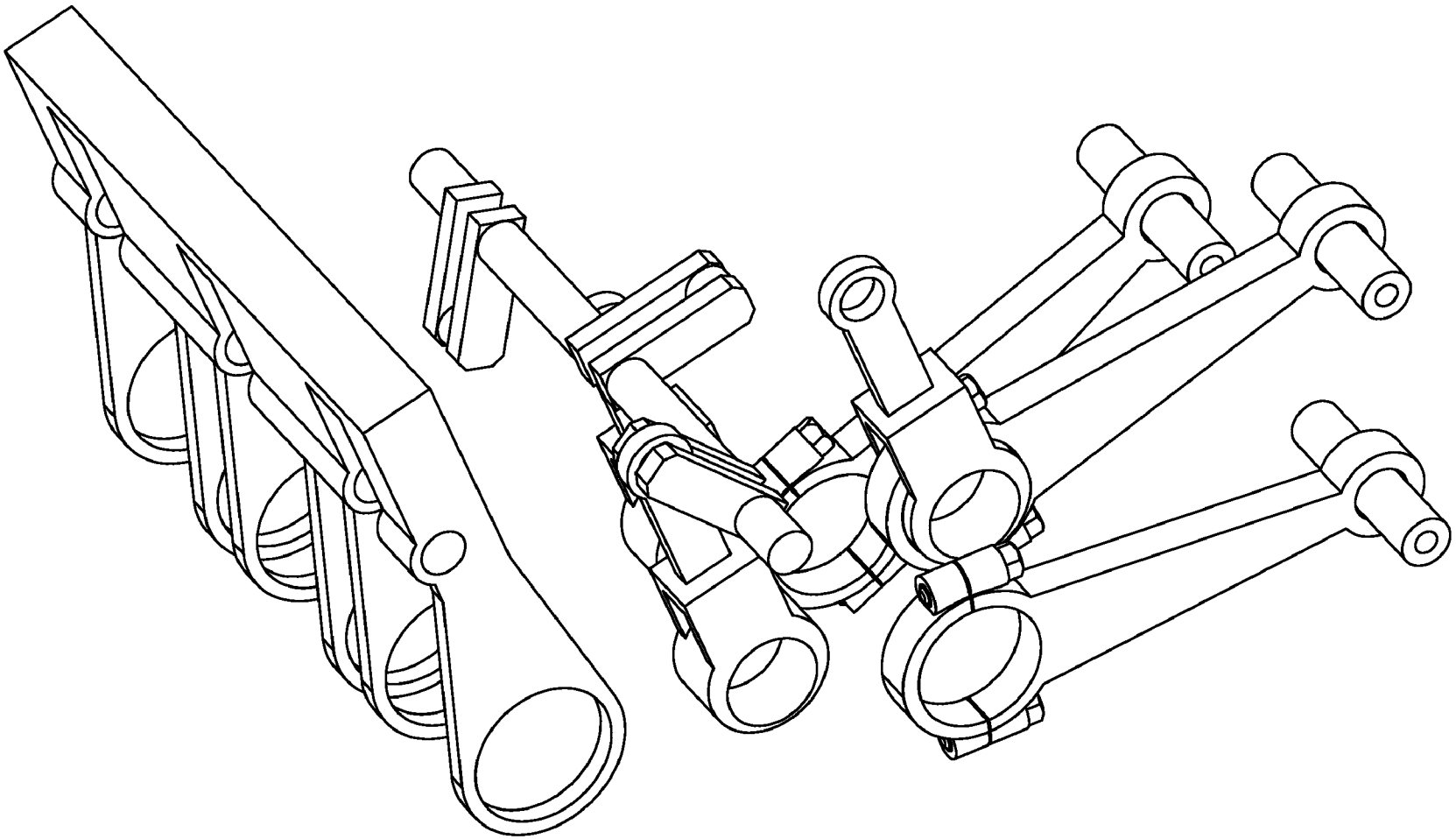
FIG. 7 shows what FIG. 6 from another viewpoint.
Figure 8:
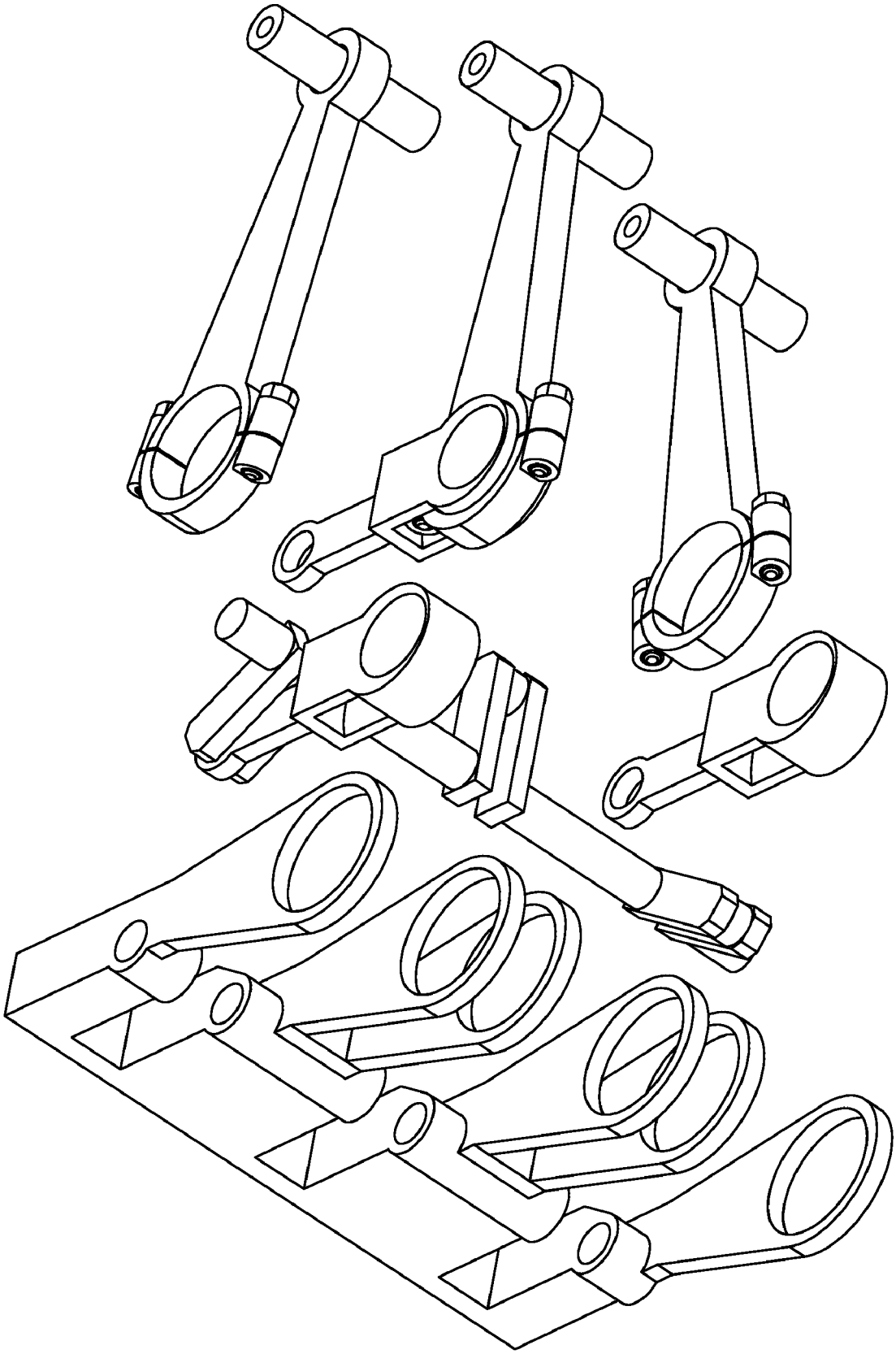
FIG. 8 shows what FIG. 6 from another viewpoint.
Figure 9:
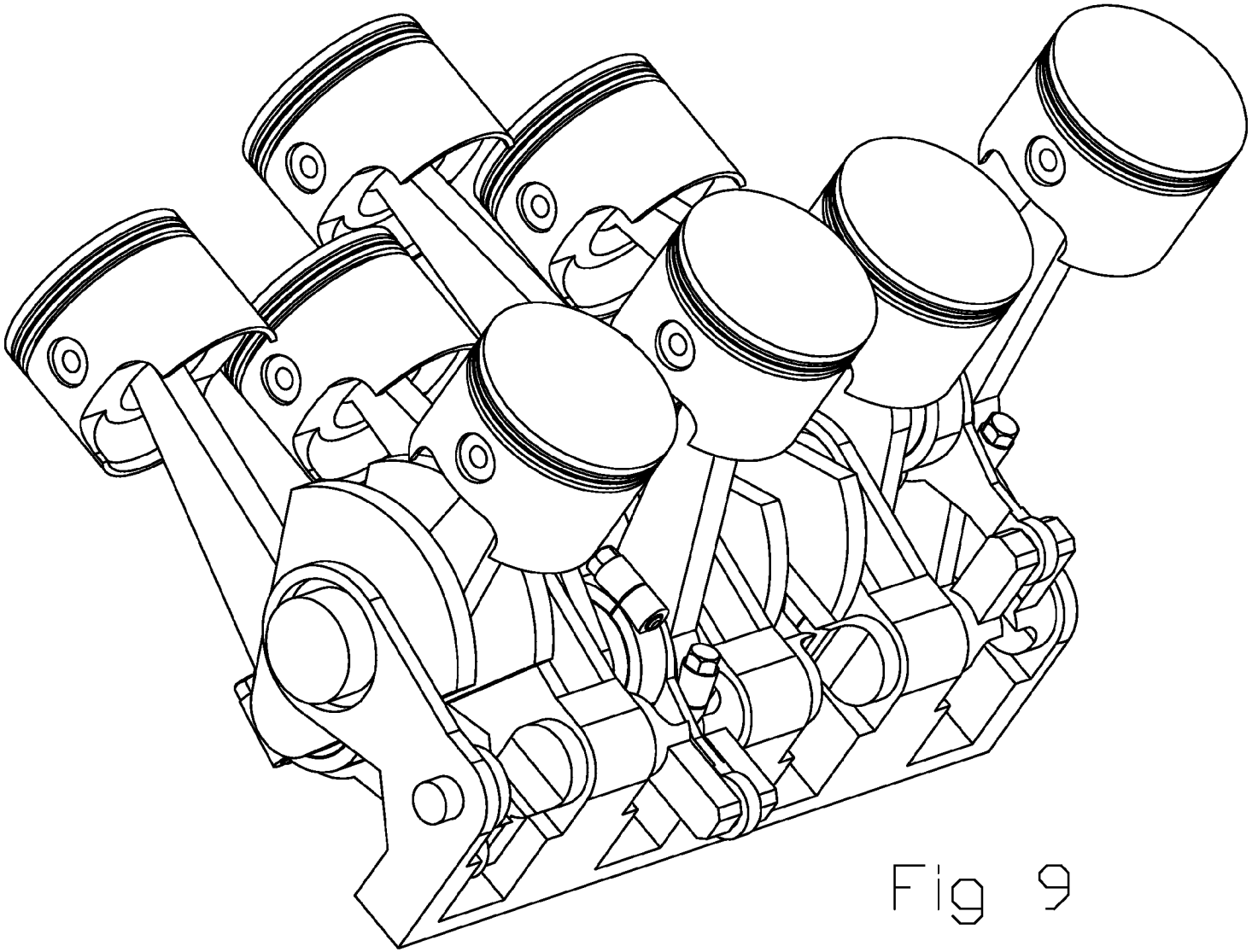
FIG. 9 shows the application of the variable compression ratio mechanism on a V-8, 90 degrees engine.
Figure 10:
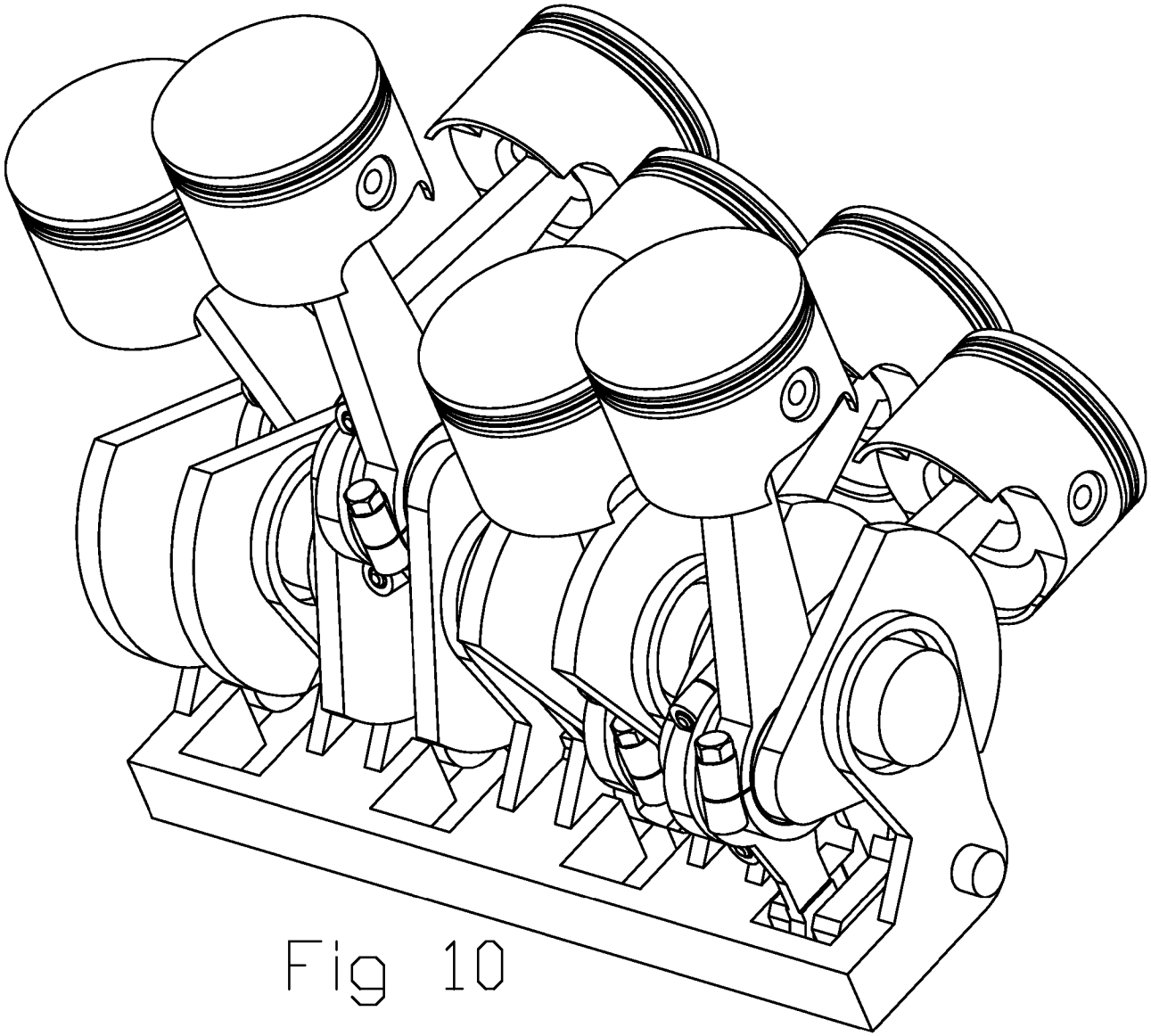
FIG. 10 shows the engine of FIG. 9 from another viewpoint.
Figure 11:
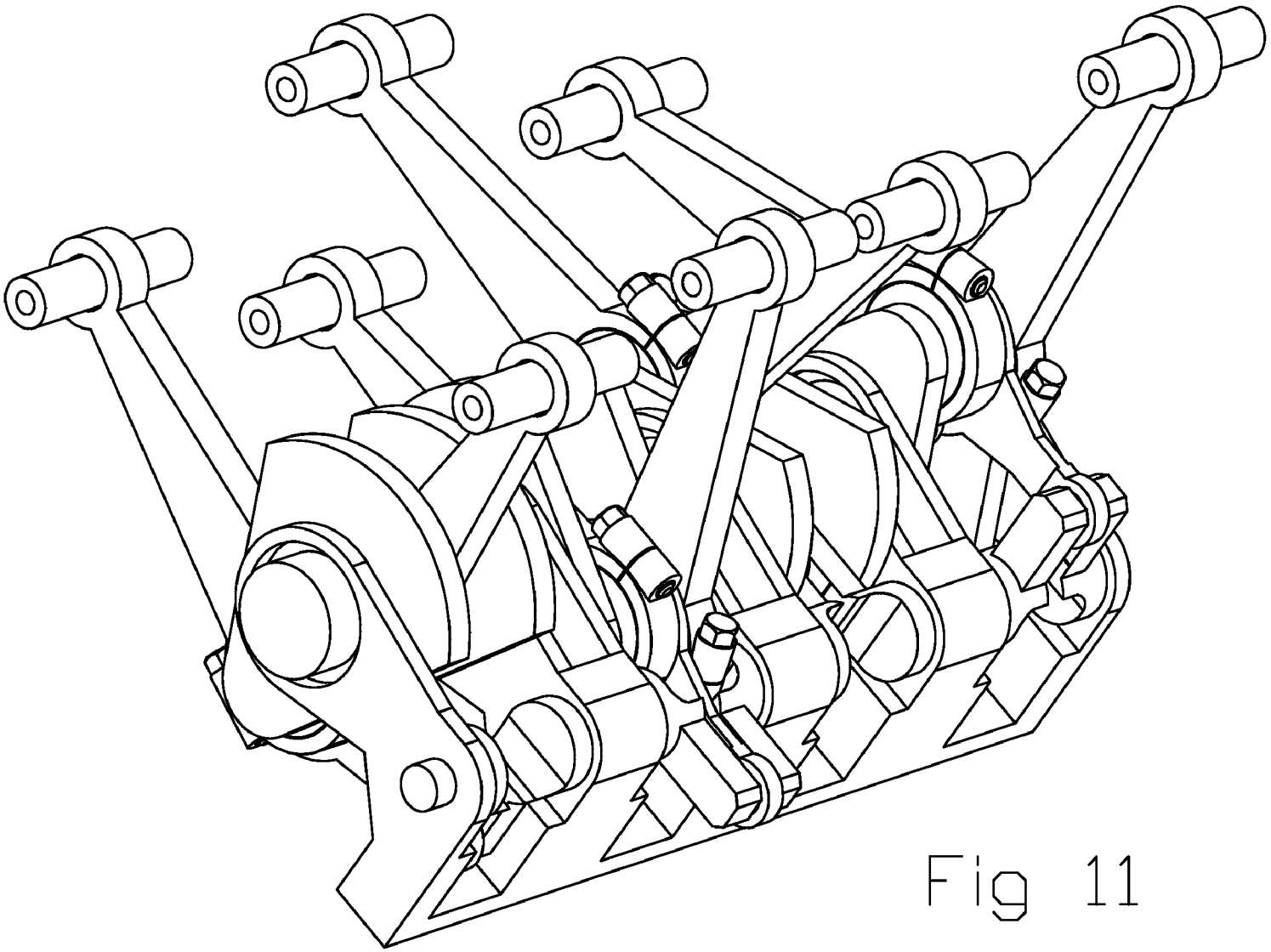
FIG. 11 shows the engine of FIG. 9 with the pistons removed.
Figure 12:
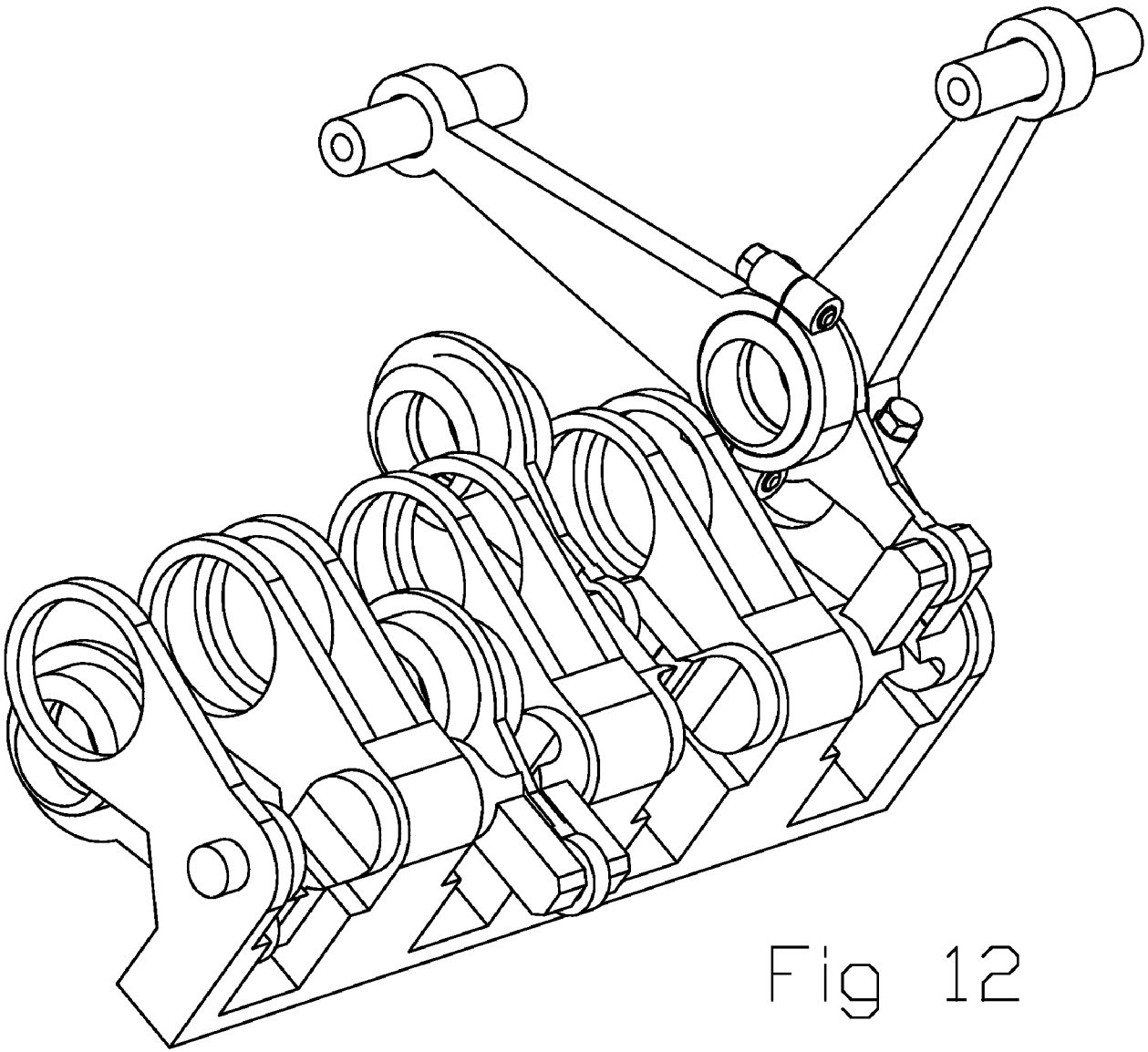
FIG. 12 shows the engine of FIG. 9 with the crankshaft and the three pairs of connecting rods removed.
Figure 13:
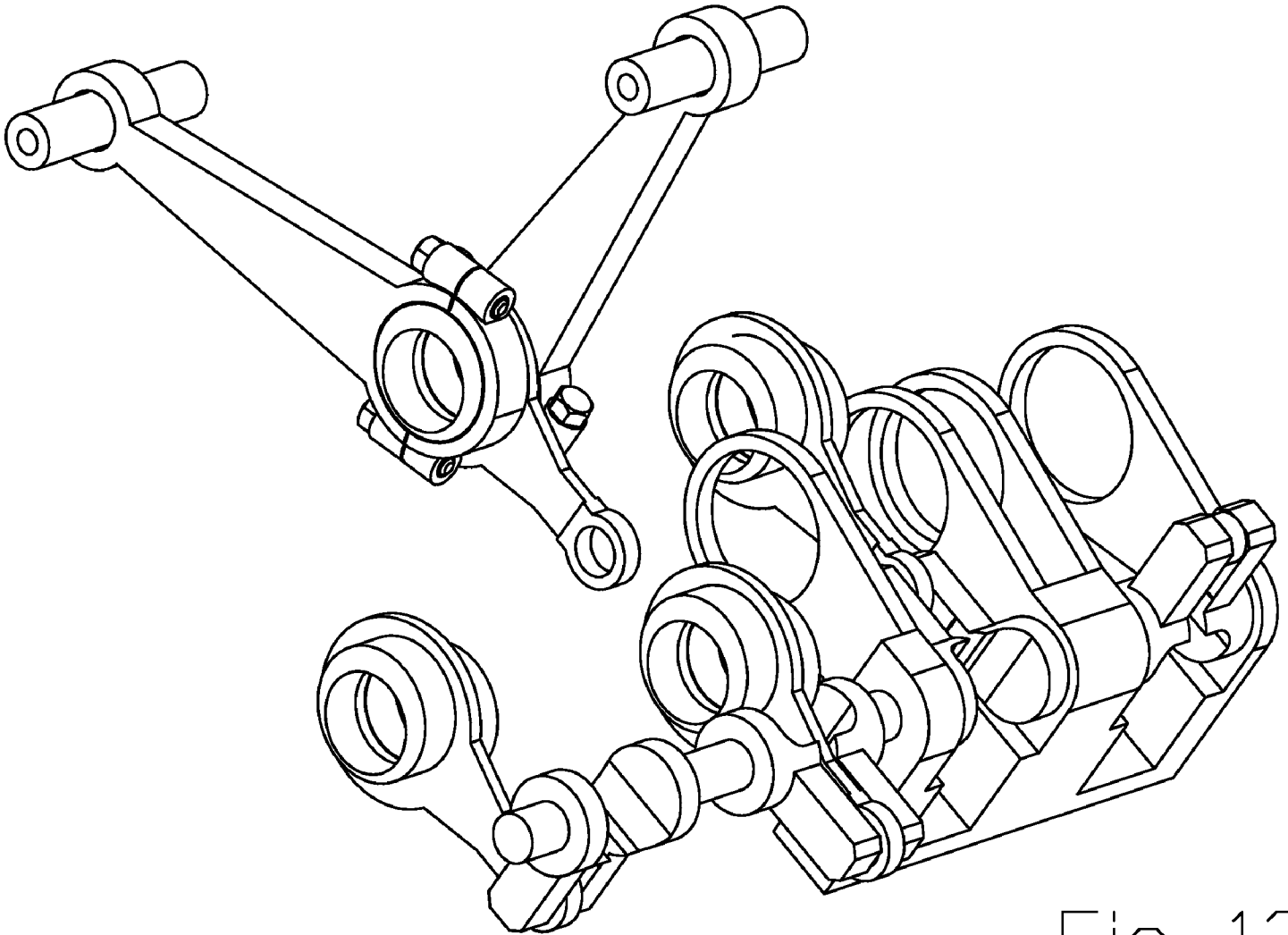
FIG. 13 shows the parts shown in FIG. 12 with the control frame sliced.
Figure 14:
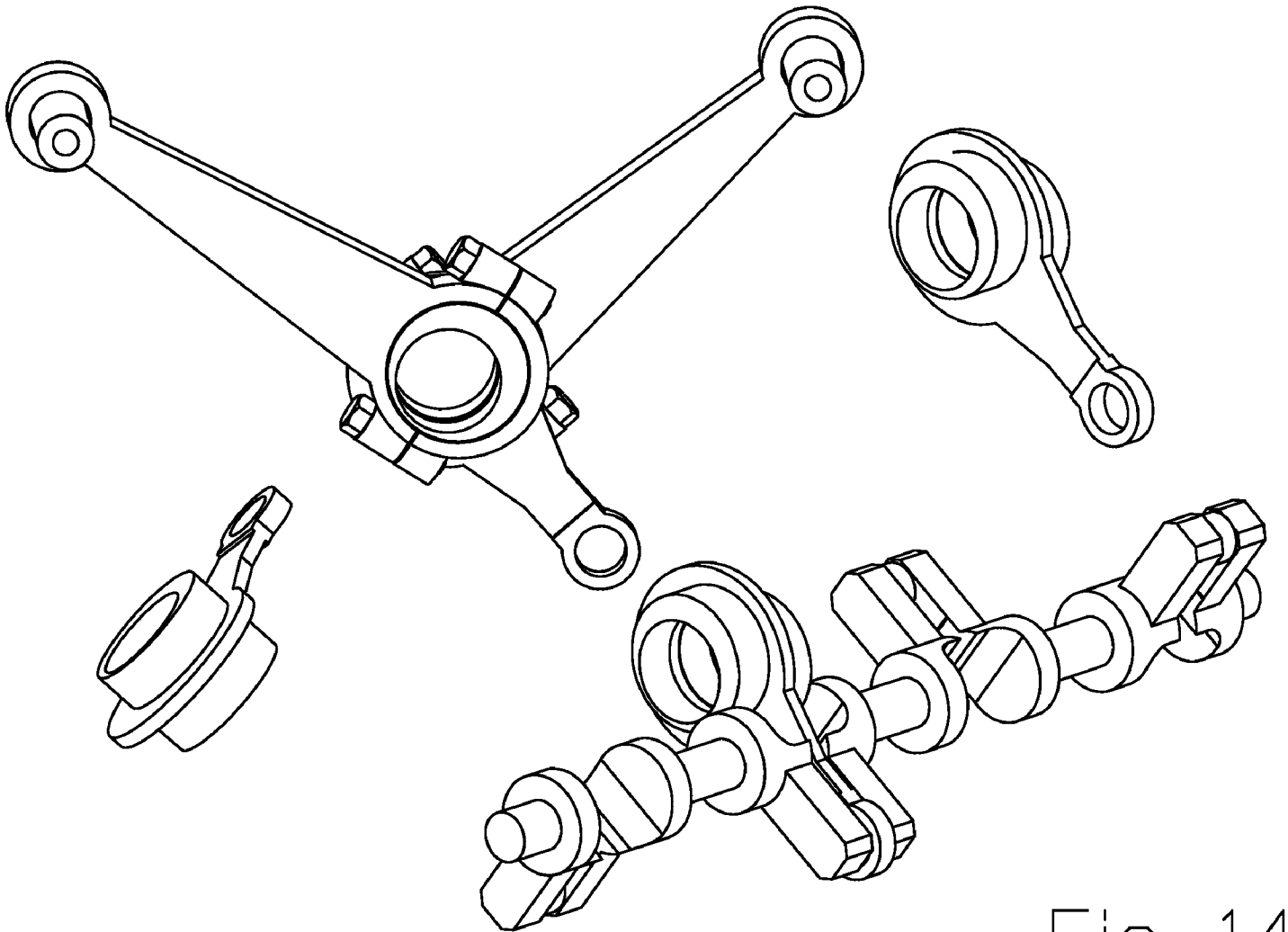
FIG. 14 shows the parts shown in FIG. 12 with the control frame removed.
Figure 15:
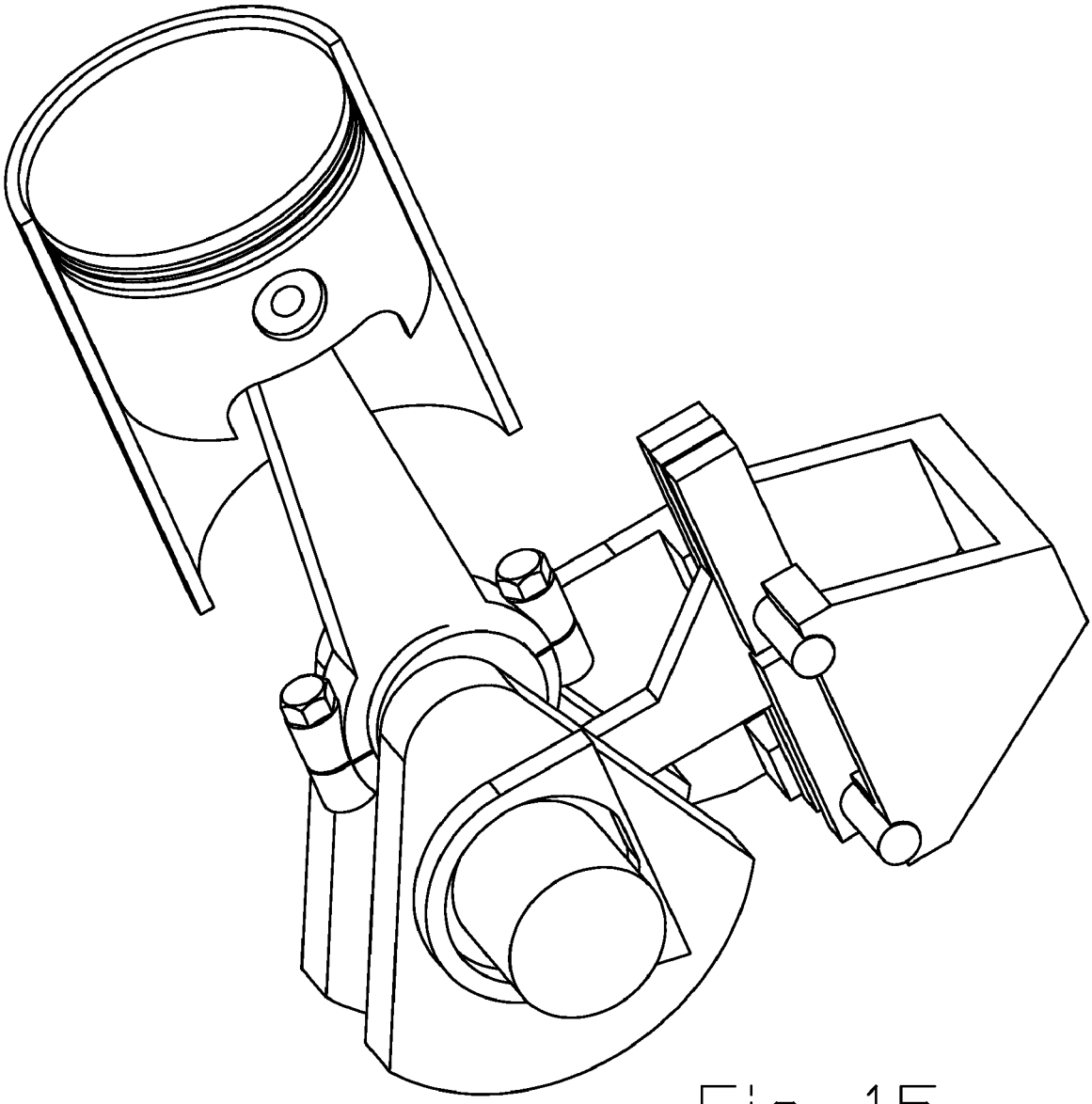
FIG. 15 shows a single cylinder at a medium compression ratio. There are two secondary crankshafts. The control frame is partially sliced to show the inner parts.
Figure 16:
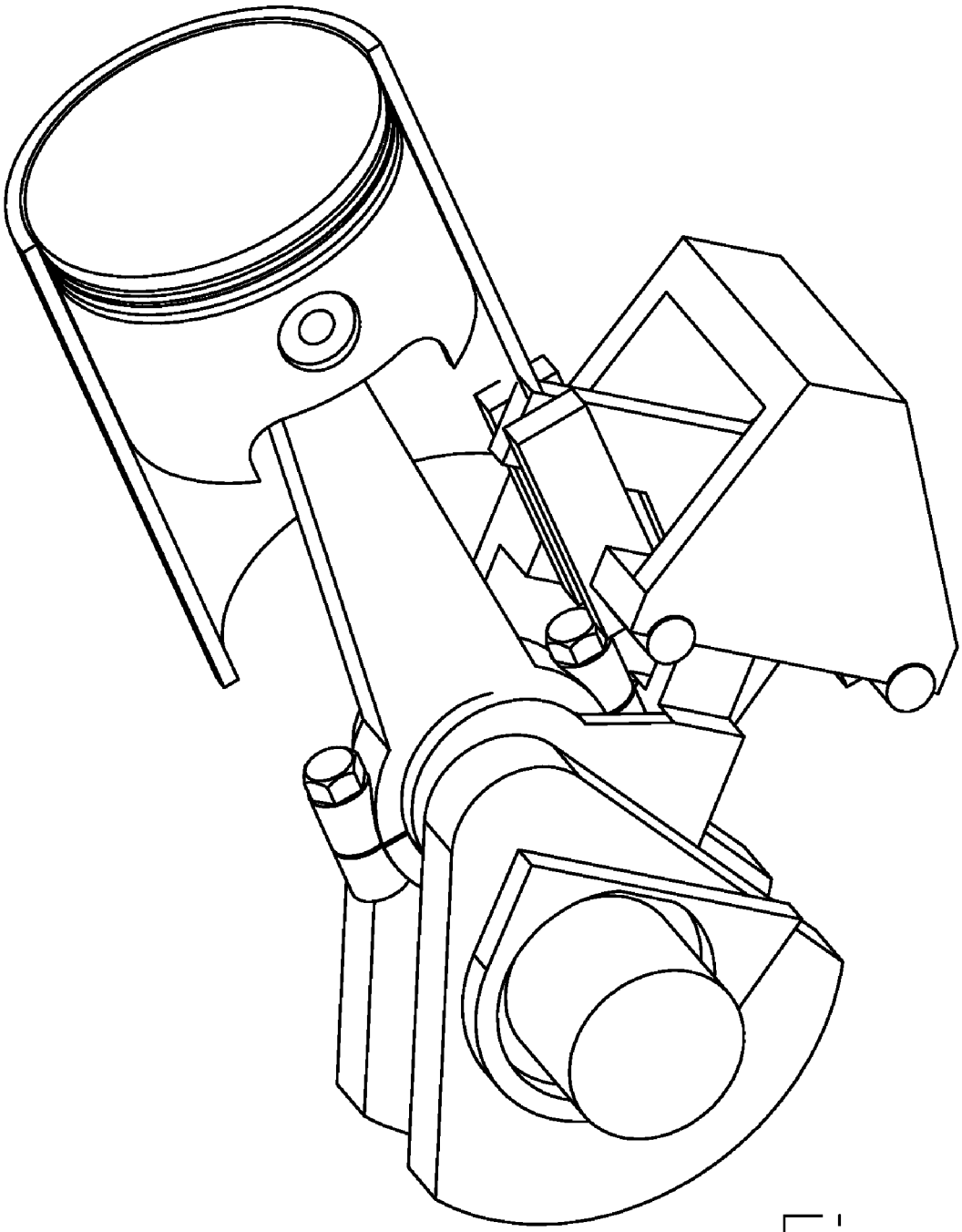
FIG. 16 shows the engine of FIG. 15 at a high compression ratio.
Figure 17:
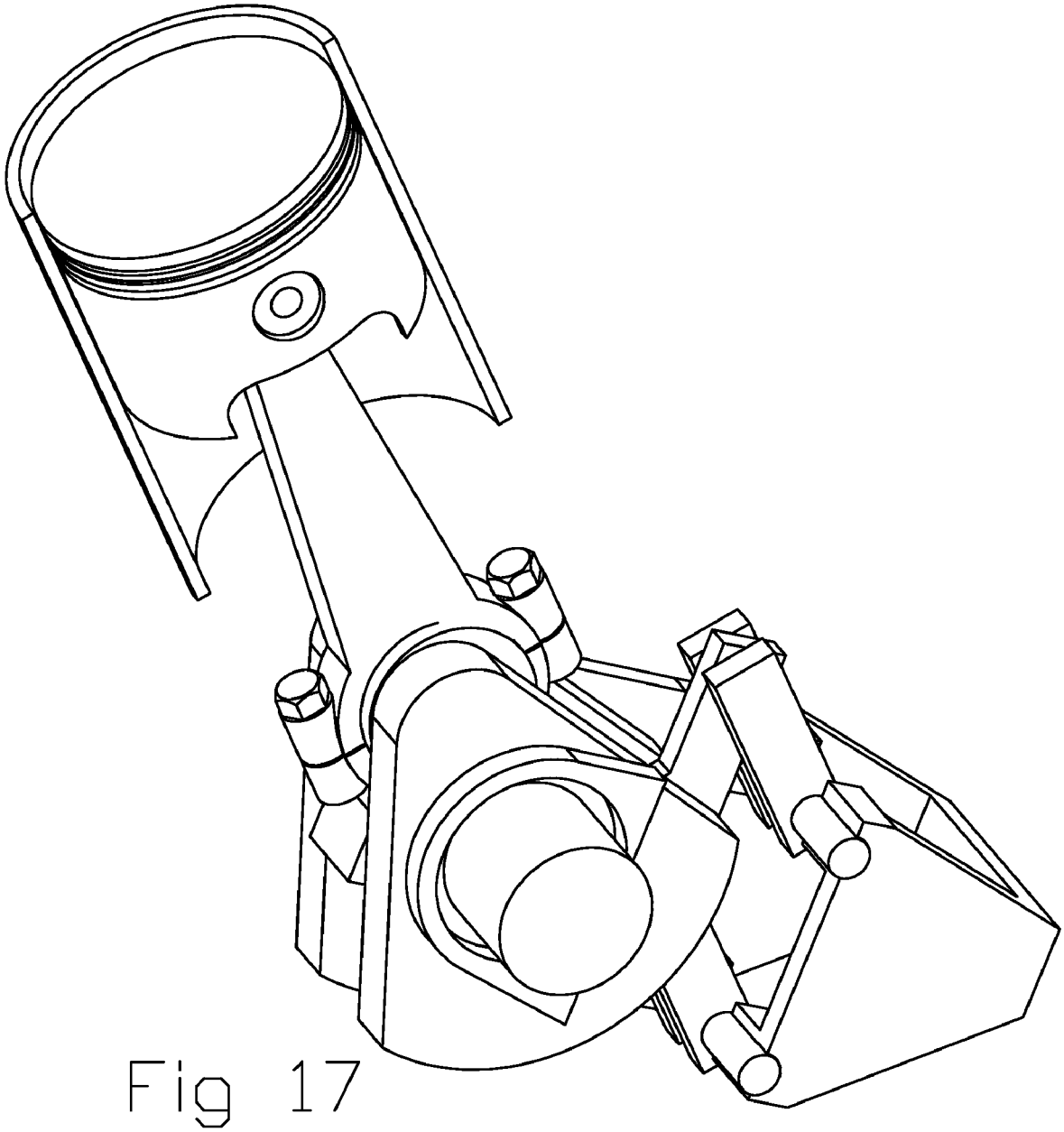
FIG. 17 shows the engine of FIG. 15 at a low compression ratio.
Figure 18:
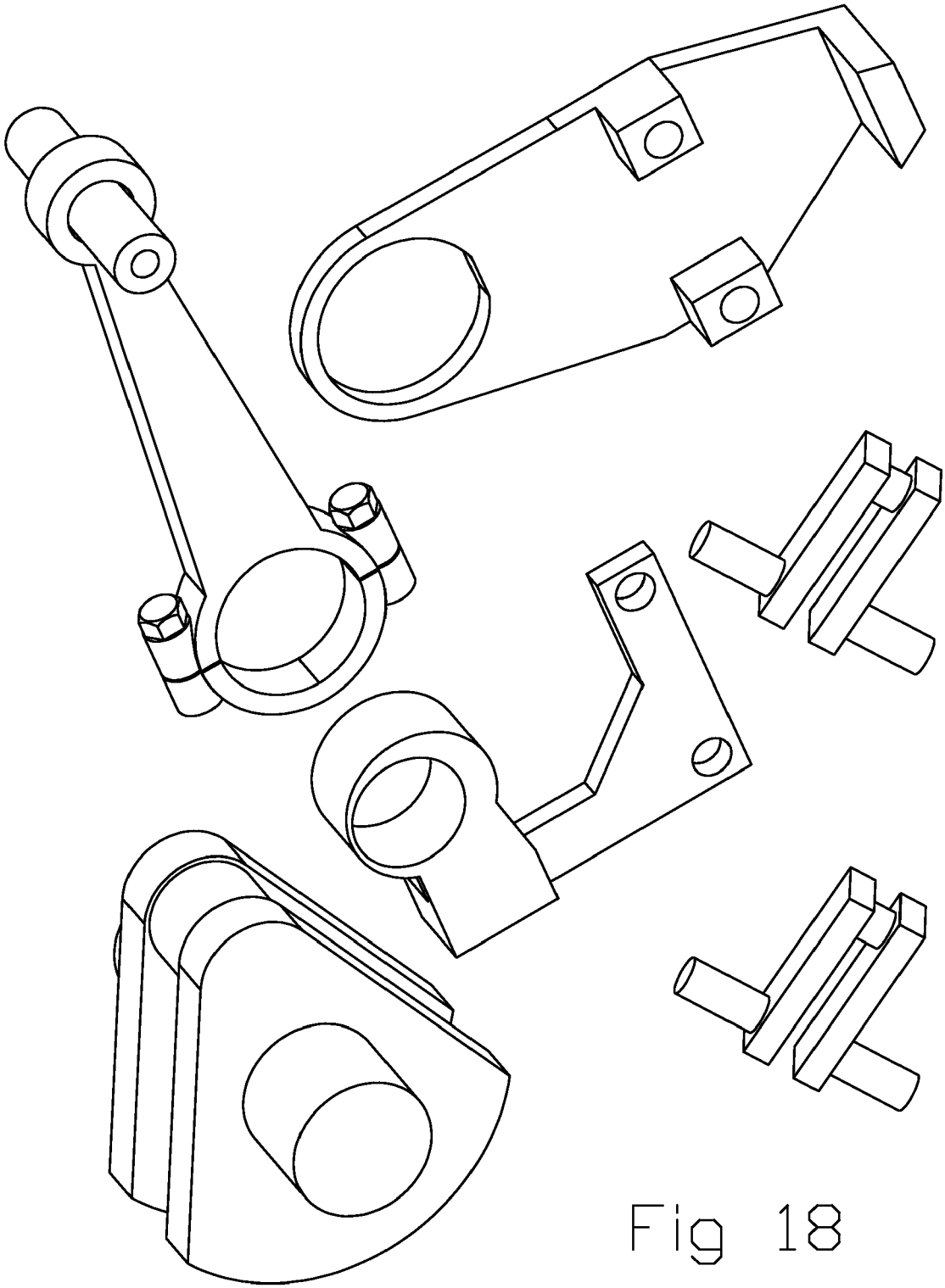
FIG. 18 shows the basic parts of the engine of FIG. 15, with the control frame sliced.
Figure 19:
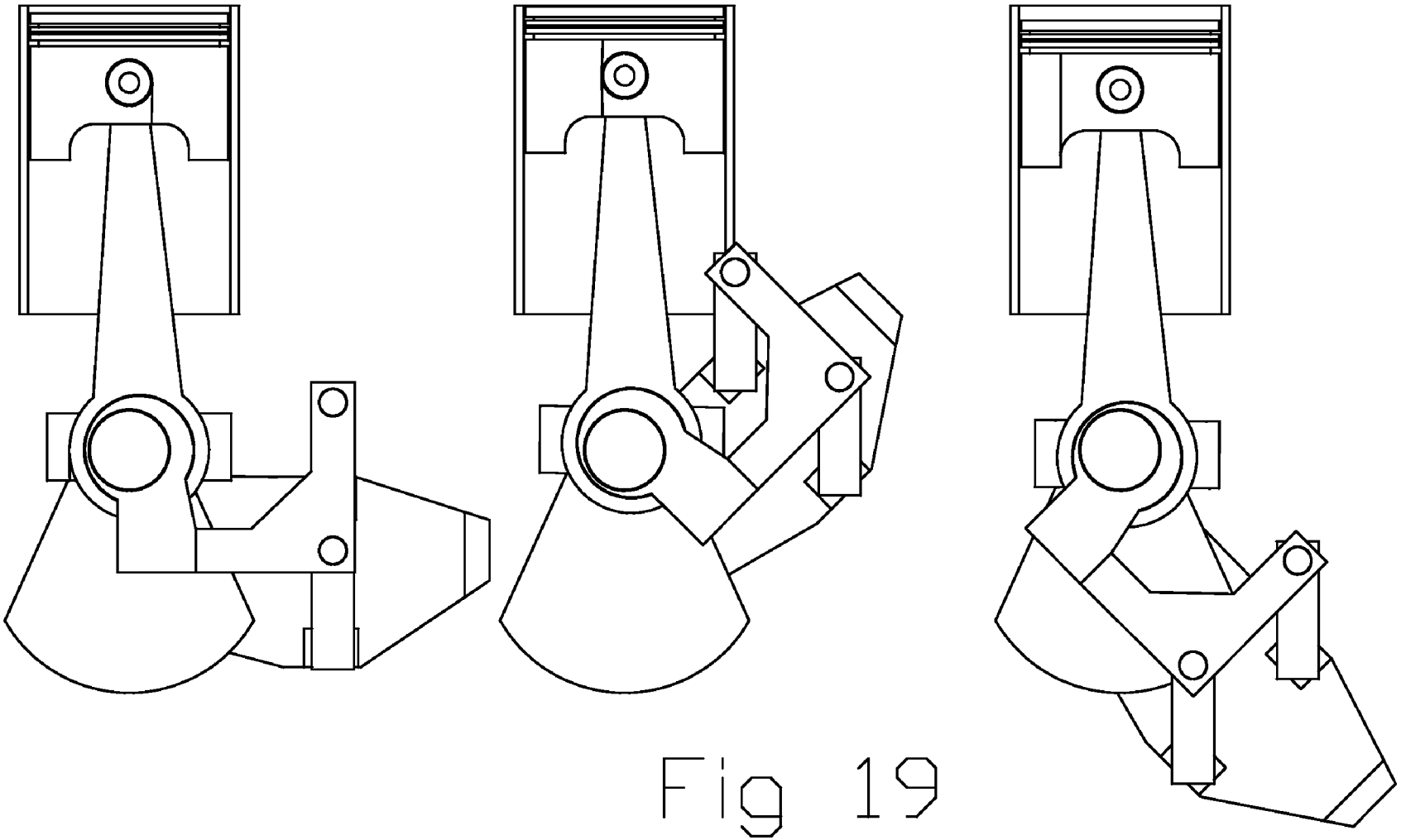
FIG. 19 shows, from left to right, the engine of FIG. 15 at medium, high and low compression ratio, with the crankshaft at TDC.
Figure 20:
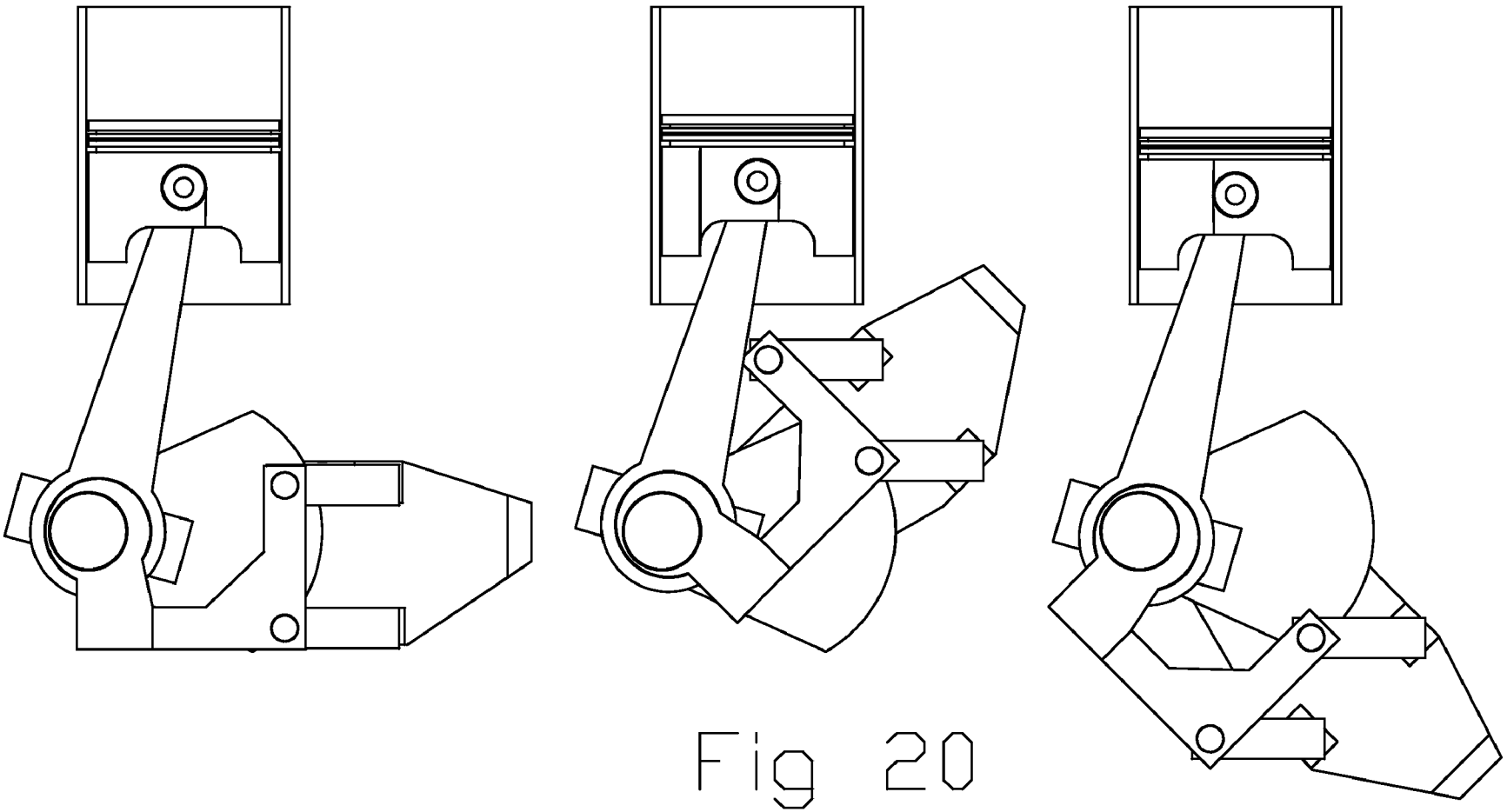
FIG. 20 shows what FIG. 19 with the crankshaft 90 degrees after TDC.
Figure 21:
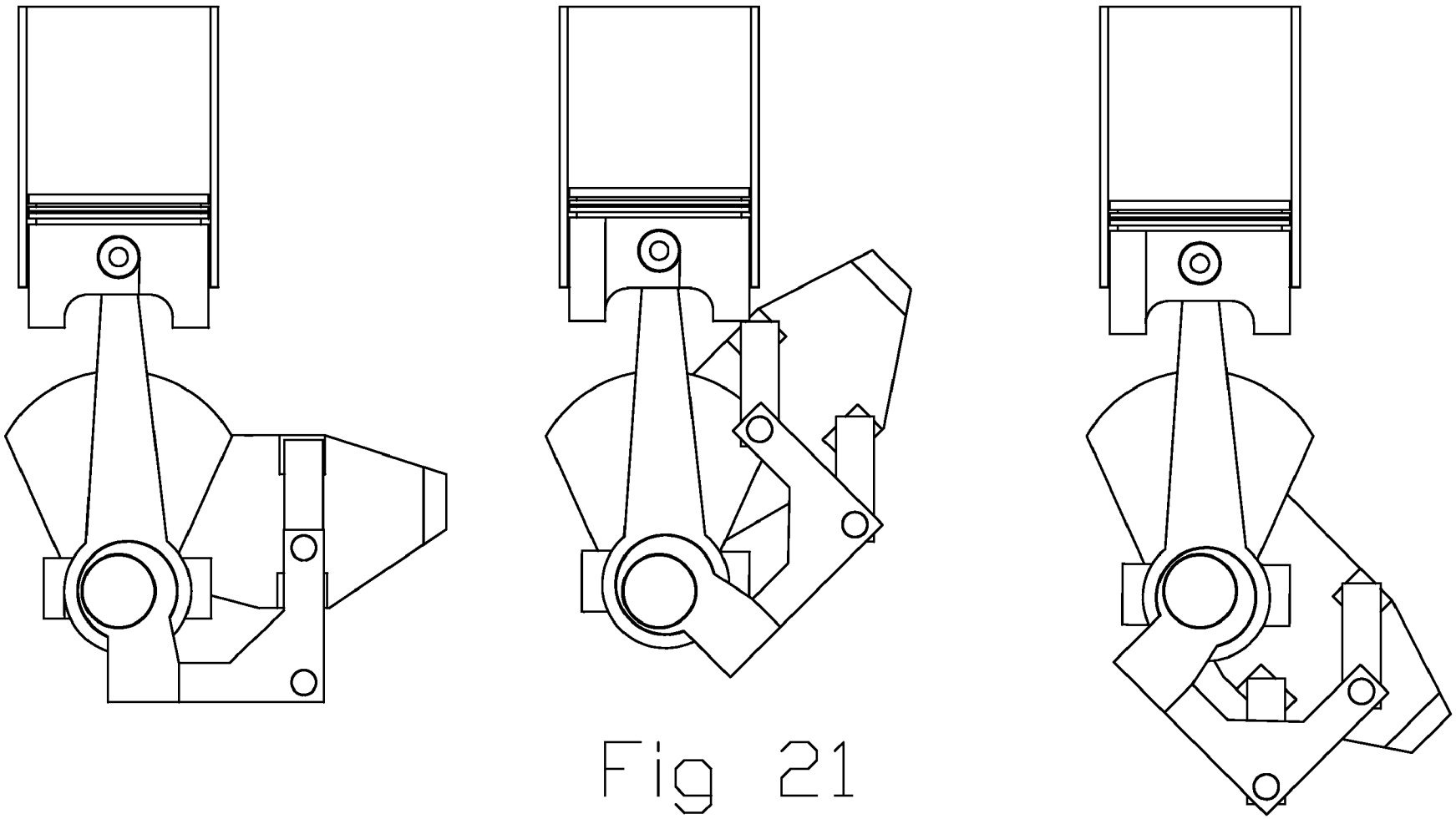
FIG. 21 shows what FIG. 19 with the crankshaft at BDC.
Figure 22:
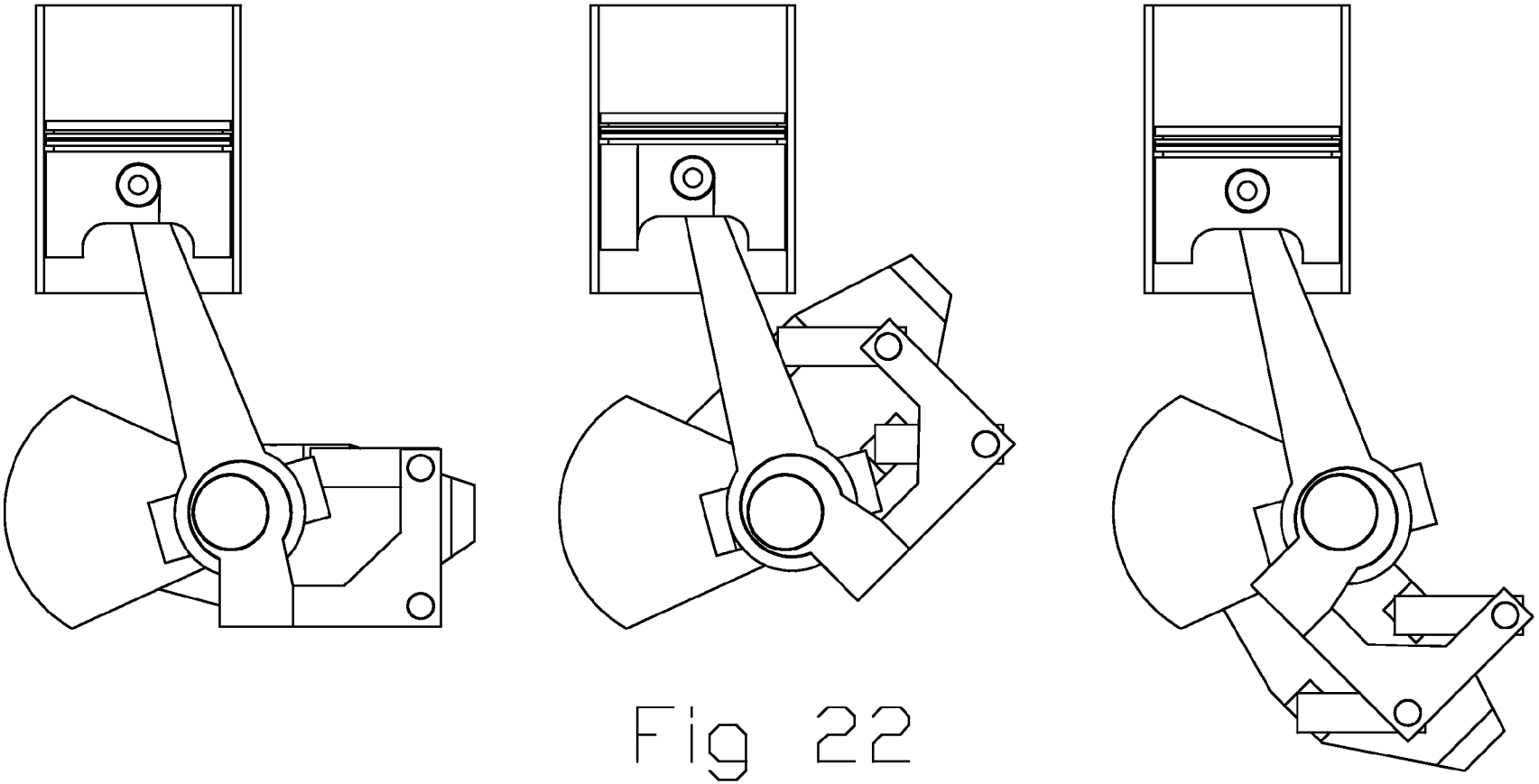
FIG. 22 shows what FIG. 19 with the crankshaft 90 degrees after BDC.

In a first preferred embodiment, FIGS. 1 to 8, in a three-cylinder in-line engine a control frame 11 is pivotally mounted on the casing 1 to pivot about the rotation axis 3 of the crankshaft 2. A secondary crankshaft 12, of the same throw with the crankshaft 2, is rotatably mounted on the control frame 11 and rotates about a rotation axis 13 of the control frame 11. Between each crankpin 4 of the crankshaft 2 and the big end 10 of the respective connecting rod 7 is interposed an eccentric ring 16 having an inner cylindrical surface 17 bearing on the crankpin 4 and an outer cylindrical surface 18 on which bears the big end 10 of the connecting rod 7. The distance E between the center of the inner cylindrical surface 17 and the center of the outer cylindrical surface 18 is the eccentricity of the eccentric ring 16. The eccentric ring 16 is secured at the one end of a secondary connecting rod 15; the other end of the secondary connecting rod 15 is rotatably mounted on a crank pin 14 of the secondary crankshaft 12. The length L of the secondary connecting rod 15, defined as the distance between the center of the inner cylindrical surface 17 of the eccentric ring 16 and the center of the crank pin 14 of the secondary crankshaft 12 equals to the distance of the crankshaft rotation axis 3 to the secondary crankshaft rotation axis 13. The rotation of the main crankshaft 2 causes, by means of the secondary connecting rods 15, the rotation of the secondary crankshaft 12 at the same direction and with the same instant angular velocity. The secondary connecting rods 15 move parallel to themselves about a center. The angular displacement of the control frame 11 about the rotation axis 3 of the crankshaft causes an equal angular displacement of all eccentric rings 16 about their crank pin centers, and this changes the compression ratio.

The angular velocity of the big end bearing 10 of the connecting rod 7 relative to the outer surface 18 of the eccentric ring 16 equals to the angular velocity of the wrist pin 9 of the connecting rod 7 and is several times smaller than the angular velocity of the big end bearing of the connecting rod, relative to the crankpin, of the conventional engine. The angular velocity of the inner surface 17 of the eccentric ring 16 relative to the crankpin 4 equals to the angular velocity of the crankshaft journals relative their bearings. The ratio L/E is about equal to the ratio of the inertia and combustion forces applied from the connecting rod 7 on the eccentric ring 16 to the inertia and combustion forces applied on the secondary crankpin 14. Typically L/E is around 20, which means that the secondary crankshaft 12 and the secondary connecting rods 15 can be light and of small dimensions, still robust for the loads they carry. For instance, if the high-pressure gas into the cylinder applies a 20,000 Nt force on the piston, the resulting force on the secondary crankpin is only 1,000 Nt.

The small dimensions of the secondary connecting rods and the temperature in the crankcase cause no heat expansion issues to the mechanism.

In a second preferred embodiment, FIGS. 9 to 14, in a conventional V-8, 90 degrees engine, four secondary connecting rods, a secondary crankshaft and a control frame are added. Between the big ends of the two connecting rods that share the same crankpin is disposed a secondary connecting rod having two eccentric rings at 90 degrees offset, one for each connecting rod. The angular displacement of the control frame for an angle f, relative to the casing, causes the angular displacement of the eight eccentric rings by the same angle f, relative to their crankpins, and so it changes equally the compression ratio of all cylinders. The balance of the engine remains as good as the conventional eight cylinder balance. As in the V engines, similarly in the W engines wherein a crankpin serves more than one pistons, a single secondary connecting rod having an eccentric ring per piston it serves, is adequate.

In a third preferred embodiment, FIGS. 15 to 22, in a single cylinder engine they are added a first secondary crankshaft, a second secondary crankshaft and a secondary connecting rod. The secondary connecting rod has at one side the eccentric ring and at the other side two bearings, one for the crankpin of the first secondary crankshaft and one for the crankpin of the second secondary crankshaft. At the moment the line from the center of the crankpin of the crankshaft to the center of the crankpin of the first secondary crankshaft is on the plane defined by the rotation axis of the crankshaft and the rotation axis of the first secondary crankshaft, the second crankshaft takes the necessary forces and the system avoids uncertainty.

To avoid the use of a second secondary crankshaft in a single cylinder, or in general in a multicylinder engine with flat crankshaft, for instance the conventional straight four or the V-8 with flat crankshaft, there is the option of using a transmission from the crankshaft to the secondary crankshaft to make them rotate at the same direction and with the same instant angular velocity, for instance by a chain and two sprockets.

To make the connection between the crankshaft and the secondary crankshaft more "flexible" to compensate for thermal expansion, construction inaccuracies and other deformations, the opposite to the eccentric ring end of the secondary connecting rod is not rotatably mounted on the crankpin of the secondary crankshaft. Instead, an additional eccentric ring is interposed between the opposite to the eccentric ring end of the secondary connecting rod and the crankpin of the secondary crankshaft.

Another way to avoid uncertainty for the case of flat crankshafts is to add to the crankshaft a crank pin out of the plane that contains the rotation axis and the crankpin centers, to add a crankpin to the single secondary crankshaft and to add an additional secondary connecting rod between them. The two additional crankpins have the same eccentricity, not necessarily equal to the eccentricity of the main crankpins.

Figure 23:
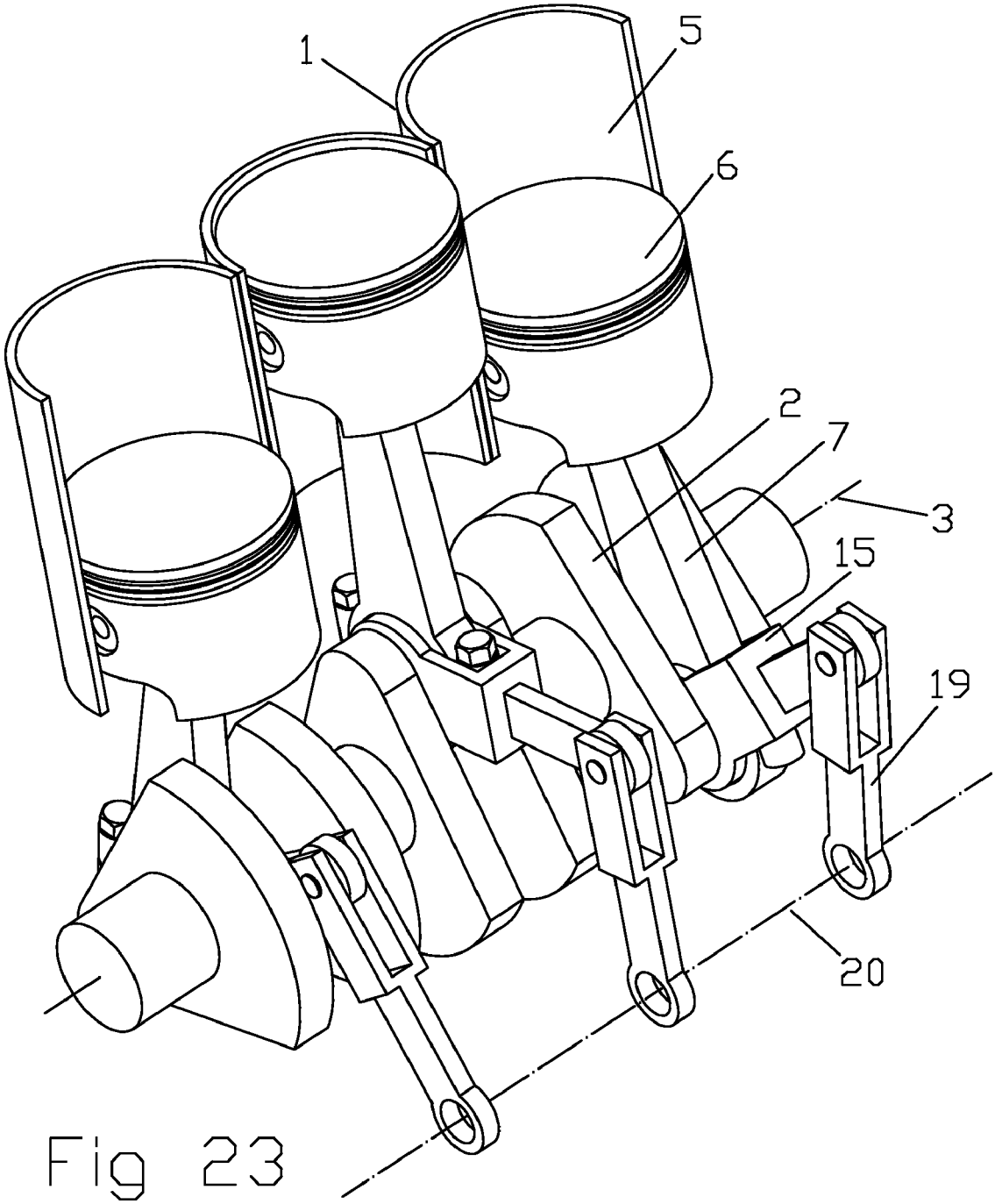
FIG. 23 shows a three-in-line engine at a medium compression ratio. Each first secondary connecting rod is pivotally mounted on an oscillating second secondary connecting rod.
Figure 24:
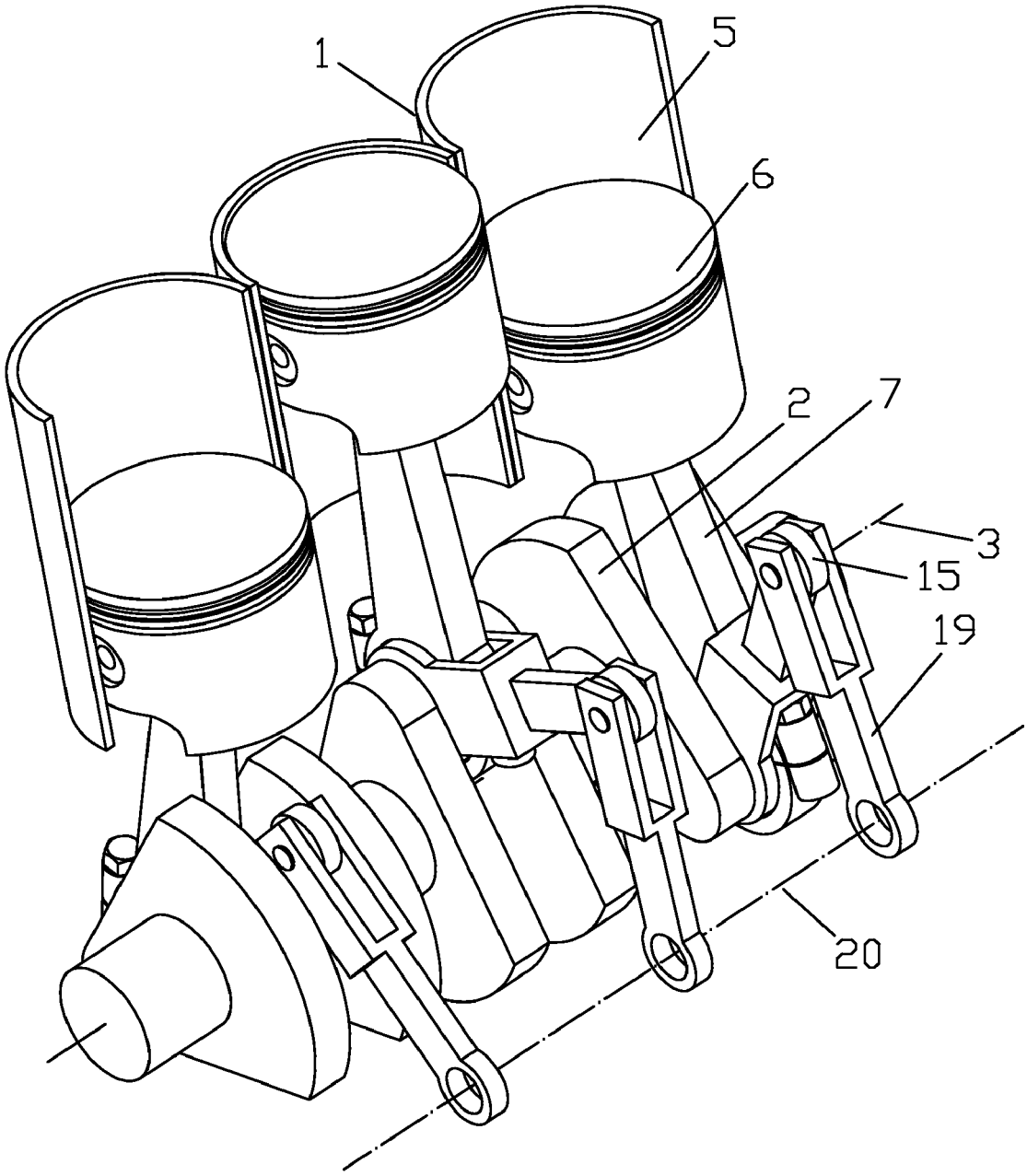
FIG. 24 shows the engine of FIG. 23 at a high compression ratio.
Figure 25:
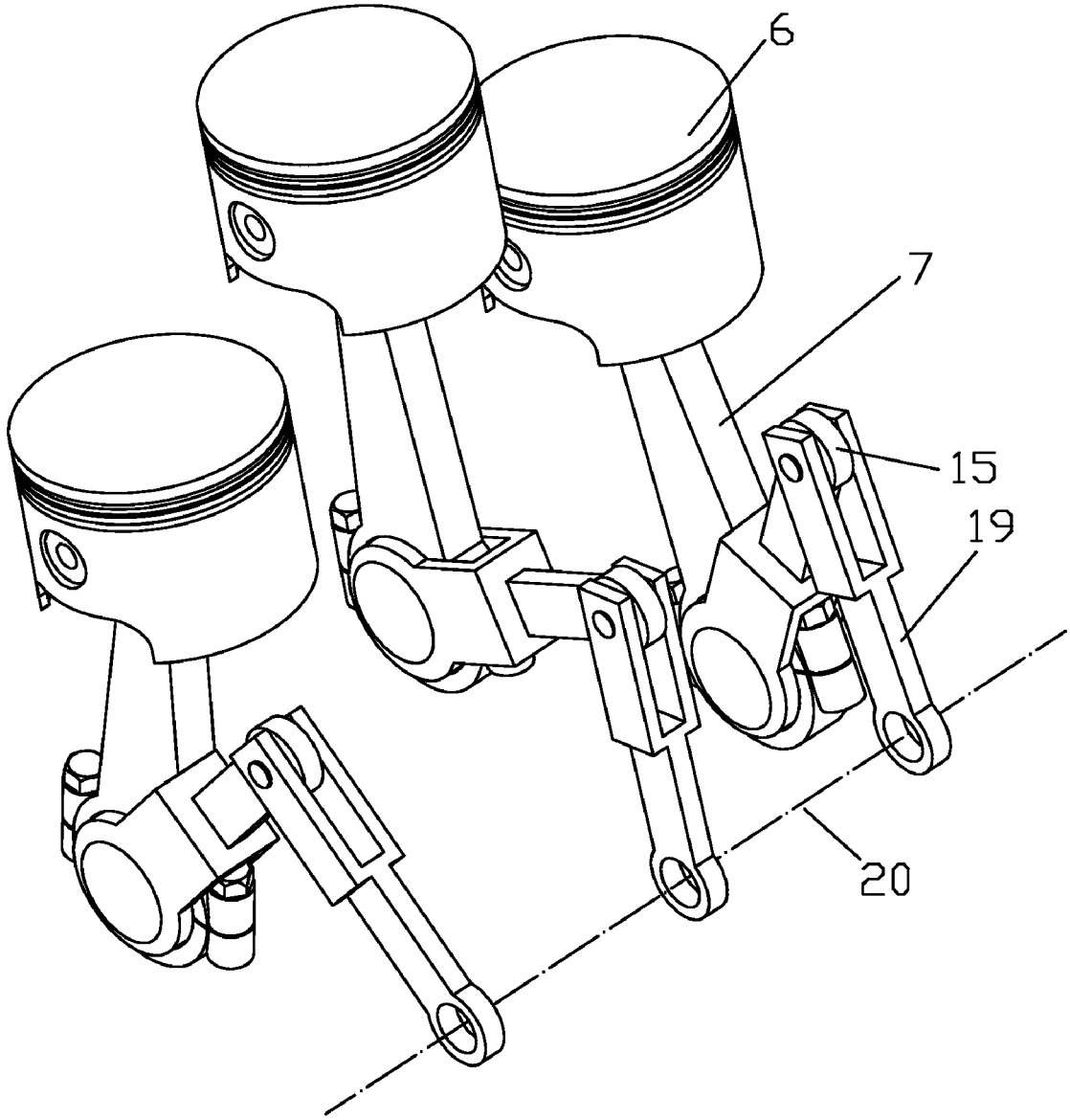
FIG. 25 shows what FIG. 24 with the crankshaft and the cylinders removed.

In a fourth embodiment, FIGS. 23 to 25, the engine of the first preferred embodiment is modified. A first secondary connecting rod 15 has the eccentric ring 16 at one end. A second secondary connecting rod 19 is pivotally mounted at one end on a displaceable pivot 20; it is also pivotally mounted at its other end on the first secondary connecting rod 15. The secondary crankshaft and the control frame have been eliminated. The center-to-center distance of the second secondary rod 19 is substantially longer than the eccentricity of the crankpin of the crankshaft. The rotation of the crankshaft makes the second secondary connecting rod 19 to perform an angular oscillation about its pivot 20. The eccentric ring 16 also performs an angular oscillation about the crankpin center. The displacement of the pivot 20 of the second secondary connecting rod 19 controls the compression ratio. The motion of the piston is deformed compared to the conventional engine, the stroke of the piston is slightly different for different compression ratios and the balance of the engine depends on the compression ratio selected.

The idea behind this invention is to take most of the loads directly by the crankpin of the crankshaft. This way the parts that control the compression ratio deal with only a slight portion of the loads, enabling compact, lightweight and robust construction and small friction due to the small mass of the moving parts and the small pin diameters. The energy delivered to the secondary crankshaft returns to the crankshaft by the set of the secondary connecting rods.

The resistance of the control frame to move, in order to change the compression ratio, is small, allowing any method known from the state-of-the-art to be used in order to control the position of the control frame, like vacuum assistant control, electric servomotor, hydraulic control etc, and thereby the response is fast.

The control frame can be pivotally mounted either on the crankshaft main journals or directly on bearings on the casing. The second case avoids the friction. The light loads the control frame undergoes, the fact that it is immovable unless a different compression ratio is desirable and the small bending loads enable the control frame support bearings being only at its outer ends.

The type of motion of the secondary connecting rods enables the complete balance of their inertia forces by the balance webs of the crankshaft and of the secondary crankshaft.

Although the invention has been described and illustrated in detail, the spirit and scope of the present invention are to be limited only by the terms of the appended claims.

What is claimed is:

1. A variable compression ratio engine comprising at least:

a casing (1);

a primary crankshaft (2) rotatably mounted on said casing (1) to rotate about a primary crankshaft rotation axis (3), said primary crankshaft (2) having a primary crankpin (4) at an eccentricity from said primary crankshaft rotation axis (3);

a cylinder (5);

a piston (6) slidably fitted into said cylinder (5);

a primary connecting rod (7), said primary connecting rod having a small end (8) pivotally mounted on said piston (6) at a wrist pin (9), said primary connecting rod having a big end (10);

a control frame (11) pivotally mounted on said casing (1) to pivot about said primary crankshaft rotation axis (3);

a secondary crankshaft (12) rotatably mounted on said control frame (11) to rotate about a secondary crankshaft axis (13) of said control frame (11), said secondary crankshaft (12) comprising a secondary crankpin (14), the secondary crankpin (14) being at an eccentricity from said secondary crankshaft axis (13) substantially equal to the eccentricity of said primary crankpin (4) from said primary crankshaft rotation axis (3);

a secondary connecting rod (15);

an eccentric ring (16) having an inner cylindrical surface (17) and an eccentric, relative to said inner cylindrical surface (17), outer cylindrical surface (18), said eccentric ring (16) being secured at one end of said secondary connecting rod (15), said eccentric ring (16) being rotatably mounted on said primary crankpin (4) by said inner cylindrical surface (17), said eccentric ring (15) being rotatably mounted on said big end (10) of said primary connecting rod (7) by said outer cylindrical surface (18), the other end of said secondary connecting rod (15) being rotatably mounted on said secondary crankpin (14) of said secondary crankshaft (12), the rotation of the primary crankshaft causes the rotation of the secondary crankshaft at the same direction and with the same instant angular velocity, the angular displacement of the control frame about the primary crankshaft rotation axis controls the compression ratio.

2. A variable compression ratio engine according claim 1 wherein the eccentricity of said outer cylindrical surface (18) relative to said inner cylindrical surface (17) is less than ½ of the eccentricity of the primary crankpin of the primary crankshaft.

3. A variable compression ratio engine according claim 1 wherein the eccentricity of said outer cylindrical surface (18) relative to said inner cylindrical surface (17) is less than ⅕ of the eccentricity of the primary crankpin of the primary crankshaft.

4. A variable compression ratio engine according claim 1 wherein an additional primary crankpin is added to the primary crankshaft, an additional secondary crankpin is added to the secondary crankshaft, a rod is rotatably mounted at one end on the additional primary crankpin and at its other end on the additional secondary crankpin, the primary crankshaft axis, the center of the primary crankpin and the center of the additional primary crank pin are substantially not coplanar.

5. A variable compression ratio engine according claim 1 wherein the primary crankshaft is synchronized to the secondary crankshaft by a transmission comprising gear wheels or sprockets.

6. A variable compression ratio engine according claim 1 wherein the secondary connecting rod is rotatably mounted on two secondary crankshafts to avoid uncertainty, the primary crankshaft rotation axis and the axes of rotation of the two secondary crankshafts are not coplanar.

7. A variable compression ratio engine according claim 1 wherein the primary crankpin of the primary crankshaft serves more than one piston and the secondary connecting rod comprises one eccentric ring per piston served by the primary crankpin of the primary crankshaft.

* * * * *